US008044309B2

(12) United States Patent
Mitchell et al.

(10) Patent No.: US 8,044,309 B2
(45) Date of Patent: Oct. 25, 2011

(54) ISOLATING APPARATUS FOR ELECTRIC POWER LINES AND METHODS FOR FORMING AND USING THE SAME

(75) Inventors: Steven Mitchell, Thompsons Station, TN (US); Owen Gregory, Apex, NC (US); Dmitry Ladin, Ontario, CA (US); Barry Johnson, Vaughan, CA (US)

(73) Assignee: Tyco Electronics Corporation, Middletown, PA (US)

( * ) Notice: Subject to any disclaimer, the term of this patent is extended or adjusted under 35 U.S.C. 154(b) by 386 days.

(21) Appl. No.: 12/342,113

(22) Filed: Dec. 23, 2008

(65) Prior Publication Data

US 2010/0155212 A1 Jun. 24, 2010

(51) Int. Cl.
*H01H 3/00* (2006.01)

(52) U.S. Cl. ..... 200/48 R; 200/17 R; 174/138 R

(58) Field of Classification Search ..... 174/138 R, 174/146, 169, 177, 44, 40 R, 148, 168, 154, 174/155, 156, 158 R, 172, 174, 135; 200/17 R, 200/16 F, 48 R, 48 P, 48 A, 48 KB, 48 V, 200/48 SB, 48 CB; 338/168, 172, 181; 439/477, 439/476.1, 480, 478, 483, 484; 337/156, 337/168, 171, 174–176, 194, 202, 203, 20
See application file for complete search history.

(56) References Cited

U.S. PATENT DOCUMENTS

| | | | | |
|---|---|---|---|---|
| 2,838,595 | A * | 6/1958 | Parkyn | 174/138 R |
| 3,300,599 | A * | 1/1967 | Lankford | 200/48 R |
| 3,499,129 | A * | 3/1970 | Gilliland et al. | 200/48 R |
| 3,813,504 | A * | 5/1974 | Anderson | 200/48 R |
| 4,405,828 | A * | 9/1983 | Shook | 174/138 R |
| 4,814,550 | A * | 3/1989 | Newberg | 174/138 R |
| 5,581,051 | A | 12/1996 | Hill | |
| 5,942,723 | A | 8/1999 | Laricchia | |
| 7,498,528 | B2 * | 3/2009 | De France | 200/17 R |
| 7,646,282 | B2 * | 1/2010 | Pazdirek | 337/172 |

FOREIGN PATENT DOCUMENTS

| | | |
|---|---|---|
| CA | 2 092 741 | 5/2004 |
| WO | WO 2008/013891 A2 | 1/2008 |

OTHER PUBLICATIONS

*FCI-BurndyA® Products Introduces New Wejtapâ„¢ In-Line Disconnect Switch for Distribution Applications*, © 2007-2008 FCI, 1 page.

*Customer Manual, AMPACT In-Line Disconnect Assemblies* 83881-, 109202-, 109203-, 109256-, 109257-, and 109258-, © 2002 Tyco Electronics Corporation, 4 pages.

*AMPACT In-Line Disconnect*, admitted prior art, 2 pages.

Invitation to Pay Additional Fees and, Where Applicable, Protest Fee, in corresponding PCT Application No. PCT/US2009/067049, mailed Mar. 16, 2010, 7 pages.

(Continued)

*Primary Examiner* — Michael Friedhofer

(74) *Attorney, Agent, or Firm* — Myers Bigel Sibley & Sajovec, PA

(57) ABSTRACT

An isolating apparatus for an electric power line includes an elongate insulator having opposed insulator ends and a pair of electrically conductive end members each secured to a respective one of the insulator ends. At least one of the end members includes a mounting slot that receives its respective one of the insulator ends.

20 Claims, 9 Drawing Sheets

OTHER PUBLICATIONS

Notification of Transmittal of the International Search Report and the Written Opinion of the International Searching Authority, or the Declaration, in corresponding PCT Application No. PCT/US2009/067049, mailed May 19, 2010, 17 pages.

Notification Concerning Transmittal of International Preliminary Report on Patentability (Chapter I of the Patent Cooperation Treaty), in corresponding PCT Application No. PCT/US2009/067049, mailed Jul. 7, 2011, 10 pages.

* cited by examiner

ISOLATING APPARATUS FOR ELECTRIC POWER LINES AND METHODS FOR FORMING AND USING THE SAME

FIELD OF THE INVENTION

The present invention relates to electrical power lines and, more particularly, to in-line isolation apparatus for electric power lines.

BACKGROUND OF THE INVENTION

In-line isolation devices such as in-line disconnect switches are commonly employed in electric power transmission lines where it is desired to permanently or selectively isolate a power line such as an overhead power line. Known isolation devices include a pair of end pieces (which may be referred to as dead ends) connected by an elongate insulator. The end pieces are each clamped to a power line. The power line is then cut between the end pieces so that the isolation device mechanically couples and electrically isolates the two ends of the power line. Examples of devices of this type are disclosed in Canadian Patent No. 2,092,741, U.S. Pat. No. 5,581,051 to Hill, and U.S. Pat. No. 5,942,723 to Laricchia.

SUMMARY OF THE INVENTION

According to embodiments of the present invention, an isolating apparatus for an electric power line includes an elongate insulator having opposed insulator ends and a pair of electrically conductive end members each secured to a respective one of the insulator ends. At least one of the end members includes a mounting slot that receives its respective one of the insulator ends.

The isolating apparatus may further include a fastener that secures the respective one of the insulator ends in the mounting slot. In some embodiments, each of the end members includes a mounting slot that receives its respective one of the insulator ends, and the isolating apparatus further includes a respective fastener securing each insulator end in its respective mounting slot. The isolating apparatus may further include a second elongate insulator having a body and opposed insulator ends, wherein: the end members are each secured to a respective one of the insulator ends of the second insulator; and each of the end members includes a second mounting slot that receives its respective one of the insulator ends of the second insulator, and the isolating apparatus further includes a respective fastener securing each insulator end of the second insulator in its respective mounting slot. In some embodiments, the end members and the first and second insulators are relatively arranged and configured such that the first and second insulators extend between the end members in spaced apart, coextensive, substantially parallel relation. According to some embodiments, the fastener is a bolt, and the respective one of the insulator ends is secured in the mounting slot by only the single bolt. In some embodiments, the insulator includes a connector lug on the respective one of the insulator ends and the connector lug is disposed in the mounting slot and the fastener engages the lug.

According to some embodiments, the mounting slot is configured to alternatively receive each of a square insulator lug and a round insulator lug.

In some embodiments, the at least one of the end members includes at least one stabilizer structure extending into the mounting slot and configured to engage the respective one of the insulator ends to limit rotation of the insulator about an axis transverse to a lengthwise axis of the insulator.

According to some embodiments, the insulator defines a lengthwise axis extending between the insulator ends, and the mounting slot opens laterally with respect to the lengthwise axis to receive the respective one of the insulator ends.

Each end member may include a coupling rod to secure the end member to the power line. The isolating apparatus can further include a wedge connector associated with each coupling rod to secure the end member to the power line.

In some embodiments, the isolating apparatus further includes: a blade switch including an electrically conductive blade member electrically and pivotally connected to one of the end members such that the blade member is selectively movable between a closed position, wherein the blade member engages the other end member to provide electrical continuity between the end members, and an open position, wherein the blade member is out of contact with the other end member; and a lockout mechanism selectively operable to secure the blade member in the open position and, alternatively, to permit the blade member to be transitioned to the closed position.

According to embodiments of the present invention, an end member for forming an isolating apparatus for an electric power line, the isolating apparatus including a pair of the end members and an elongate insulator, includes an electrically conductive end member body having a mounting slot defined therein. The mounting slot is arranged and configured to receive an insulator end of the insulator.

The end member may include a fastener to secure the insulator end to the end member. According to some embodiments, the end member body has a second mounting slot defined therein, and the second mounting slot is arranged and configured to receive an insulator end of a second insulator to secure the insulator end of the second insulator to the end member such that the first and second insulators extend from the end member in spaced apart, coextensive, substantially parallel relation.

In some embodiments, the mounting slot is configured to alternatively receive each of a square insulator lug and a round insulator lug of the insulator.

According to some embodiments, the end member includes at least one stabilizer structure extending into the mounting slot and configured to engage the insulator end to limit rotation of the insulator about an axis transverse to a lengthwise axis of the insulator.

In some embodiments, the insulator defines a lengthwise axis extending between the insulator ends, and the mounting slot opens laterally with respect to the lengthwise axis to receive the respective one of the insulator ends.

The body can include a coupling rod to secure the end member to the power line.

According to method embodiments of the present invention, a method for providing an isolation apparatus for an electric power line includes: securing a pair of electrically conductive end members to respective opposed insulator ends of an elongate insulator. The step of securing includes inserting at least one of the insulator ends in a mounting slot of the respective end member.

The step of securing may include securing the insulator end in the mounting slot with a fastener. According to some embodiments, the fastener is a bolt, and the respective one of the insulator ends is secured in the mounting slot by only the single bolt. The step of securing may include inserting each of the insulator ends in a mounting slot of its respective end member, and securing each insulator end in the associated mounting slot with a respective fastener. The method may further include securing a second elongate insulator to the end members by inserting each of the insulator ends in a respective mounting slot of its respective end member, and securing each insulator end in the associated mounting slot with a respective fastener, such that the first and second insulators extend between the end members in spaced apart, coextensive, substantially parallel relation.

The method can include, prior to the step of securing: providing a plurality of insulators of different lengths; and selecting the insulator from the plurality of insulators, wherein the length of the insulator corresponds to a desired voltage rating. In some embodiments, the method includes: providing a plurality of electrically conductive blade members of different lengths; selecting a blade member from the plurality of blade members, wherein the length of the blade member corresponds to the length of the selected insulator; and electrically and pivotally connecting the blade member to one of the end members such that the blade member is selectively movable between a closed position, wherein the blade member engages the other end member to provide electrical continuity between the end members, and an open position, wherein the blade member is out of contact with the other end member.

According to embodiments of the present invention, an isolating apparatus for an electric power line includes an elongate insulator, first and second electrically conductive end members, a blade switch, and a lockout mechanism. The elongate insulator has opposed insulator ends. The first and second electrically conductive end members are each secured to a respective one of the insulator ends. The blade switch includes an electrically conductive blade member electrically and pivotally connected to the first end member. The blade member is selectively movable between a closed position, wherein the blade member engages the second end member to provide electrical continuity between the first and second end members, and an open position, wherein the blade member is out of contact with the second end member. The lockout mechanism is selectively operable to secure the blade member in the open position and, alternatively, to permit the blade member to be transitioned to the closed position.

The locking mechanism may include a lock member that extends through the blade member when the blade member is in the open position.

In some embodiments, the locking mechanism includes a locking member that is rotatable between a locked position and an unlocked position. The isolating apparatus may include a spring member to retain the locking member in the locked position.

Further features, advantages and details of the present invention will be appreciated by those of ordinary skill in the art from a reading of the figures and the detailed description of the preferred embodiments that follow, such description being merely illustrative of the present invention.

DETAILED DESCRIPTION OF EMBODIMENTS OF THE INVENTION

Figure 1:
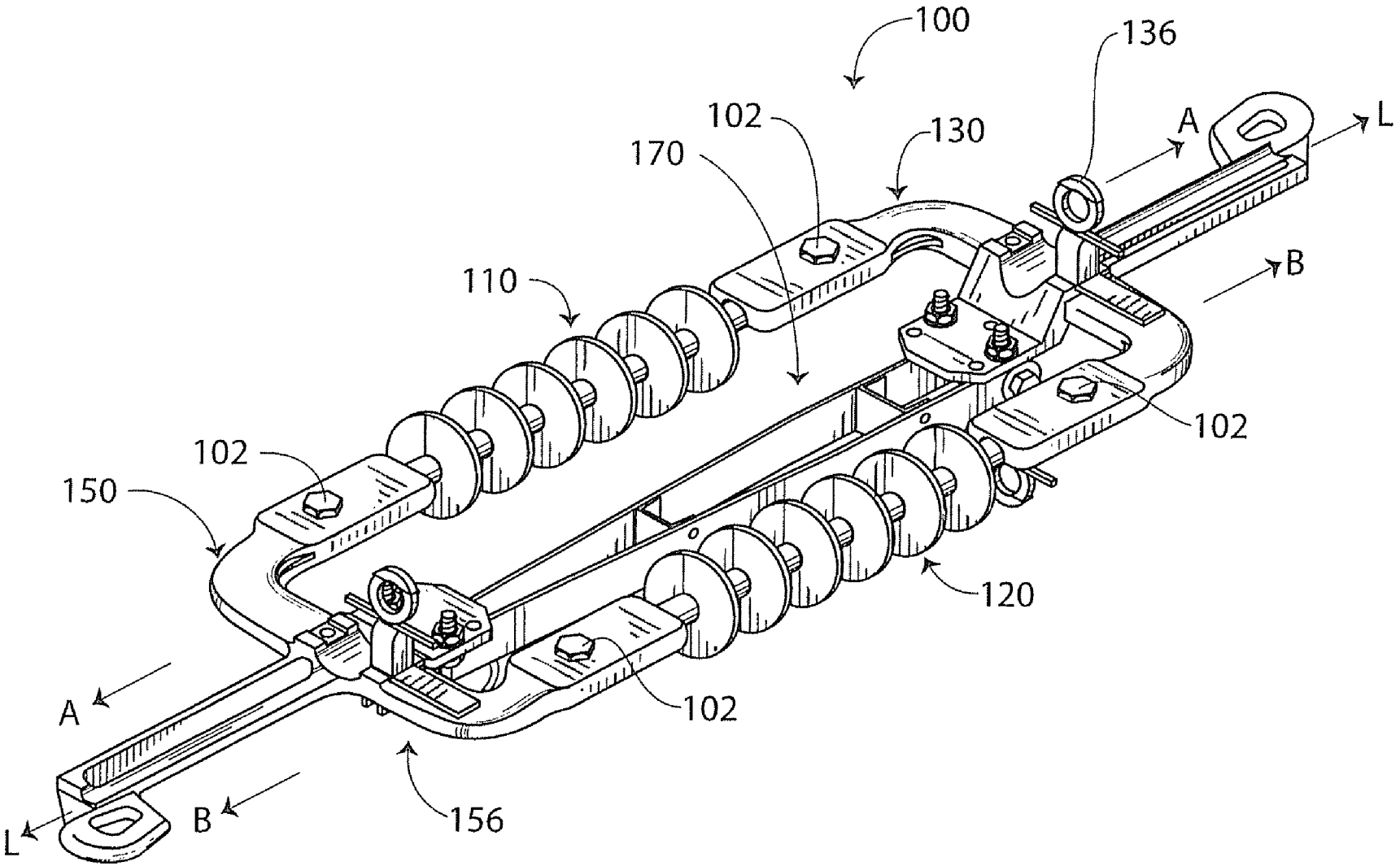
FIG. 1 is a top perspective view of an isolating apparatus according to embodiments of the present invention.
Figure 2:
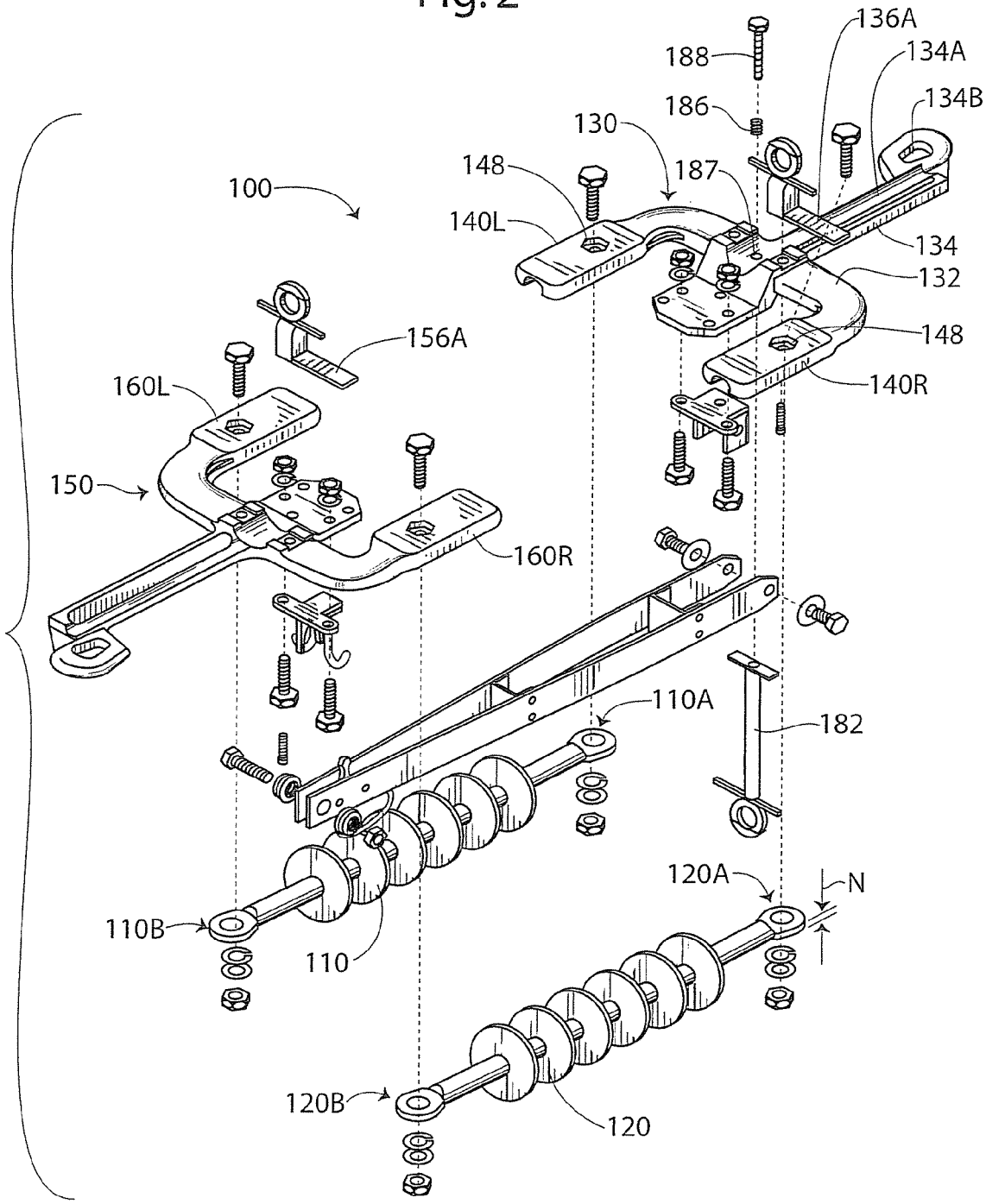
FIG. 2 is an exploded, top perspective view of the isolating apparatus of FIG. 1.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90° or at other orientations) and the spatially relative descriptors used herein interpreted accordingly.

As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this specification and the relevant art and will not be interpreted in an idealized or overly formal sense unless expressly so defined herein.

With reference to FIGS. 1-12, an in-line isolating apparatus 100 according to embodiments of the present invention is shown therein. The isolating apparatus 100 may be used with a pair of wedge connectors 20 (or other suitable connectors) to form an in-line isolation assembly 5 (FIGS. 8-11) wherein a pair of power lines, cable segments or cables 12, 14 are mechanically coupled and electrically isolated by the isolating apparatus 100. The cables 12, 14 may be initially provided as an integral (mechanically and electrically continuous) power line 10 that is severed into the cables 12, 14 as part of the procedure for forming the in-line isolation assembly 5. The isolating apparatus 100 may be referred to as an in-line disconnect device or an in-line switch because it further incorporates a switch mechanism as discussed herein.

The isolating apparatus 100 includes a pair of end members 130, 150 joined by a pair of insulators 110, 120. The isolating apparatus 100 further includes a blade switch mechanism 170 and a plurality of connecting bolts 102, nuts 104, and washers 106. Some or all of the fastening components 102, 104, 106 may be replaced with other types of fastening components such as rivets. The isolating apparatus 100 has a lengthwise axis L-L (FIG. 1).

The insulator 110 is elongate and has opposed ends 110A, 110B and a lengthwise insulator axis A-A (FIG. 1). The insulator 110 includes an electrically insulating body 112 and connector lugs 116 secured to either end of the body 112 (e.g., by crimping). The insulating body 112 may be of any suitable construction. According to some embodiments, the insulating body 112 includes a rigid (e.g., fiberglass) rod surrounded by a rubberized cover. Radially outwardly extending sheds 114 may be provided, which may form a part of the rubberized cover. According to some embodiments, the insulating body 112 is formed of any suitable material, such as aluminum. A fastening hole 118 extends laterally through each lug 116.

The insulator 120 may be formed in the same manner as described above for the insulator 110 and has a lengthwise axis B-B, opposed ends 120A, 120B, an insulating body 122 (with sheds 124), and lugs 126 (with fastening holes 128).

The end member 130 (which may also be referred to as a "dead end") includes a body or yoke member 132 and a coupling rod 134, which may be integrally formed with the yoke member 132. A lengthwise cable groove 134A is defined in the coupling rod 134, and a pulling eye 134B is provided on an outer end of the rod 134.

Figure 8:
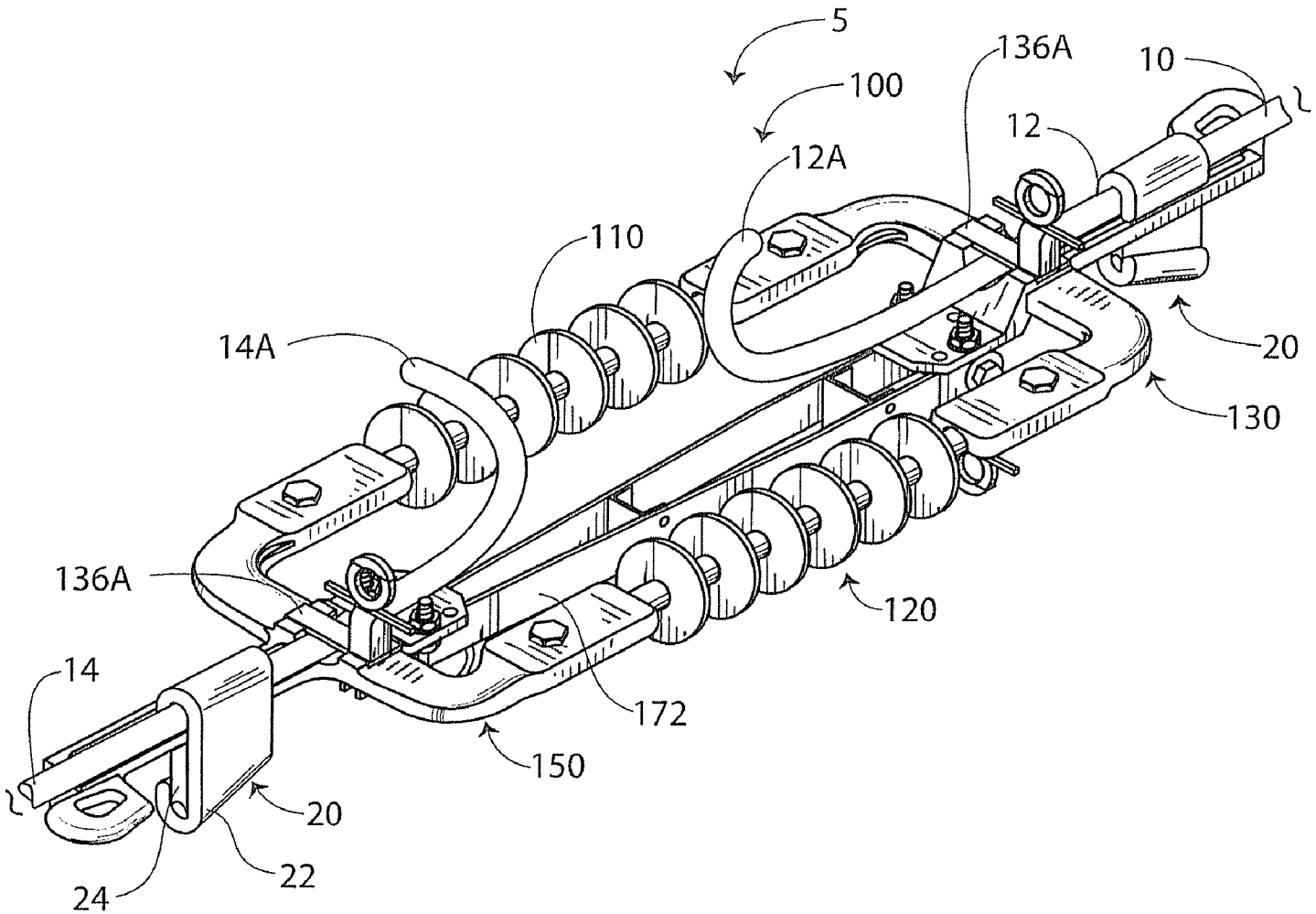
FIG. 8 is a top perspective view of the isolating apparatus of FIG. 1 mounted on the power line, wherein a blade switch mechanism of the isolating apparatus is in a closed position.

The end member 130 further includes a retainer mechanism 136. The retainer mechanism 136 includes a keeper bar 136A rotatable between an open position (as shown in FIG. 1) and a closed position (as shown in FIG. 8). In the open position, the keeper bar 136A permits a cable to be laid laterally into the groove 134A and, in the closed position, the keeper bar 136A can prevent a cable from being laterally removed from the groove 134A. According to some embodiments, the retainer mechanism 136 is constructed and operable as disclosed in U.S. Pat. No. 5,942,723 to Laricchia, the disclosure of which is incorporated herein by reference.

Laterally spaced apart mounting structures 140L, 140R are located on the inner end of the yoke member 132, and may be integrally formed (e.g., by casting) therewith. A mounting pocket or slot 142 is defined in each mounting structure 140L, 140R. Each mounting slot 142 has a lengthwise axis C-C substantially parallel to the axis A-A. Each mounting slot 142 has an axial entrance opening 144A and a lateral opening 144B. A fastener hole 148 extends laterally through each mounting structure 140L, 140R to the mounting slot 142 thereof. A stabilizer structure 146 is located in each mounting slot 140L, 140R and may take the form of a U-shaped ring as shown. Each stabilizer structure 146 defines a slot 146A. Each stabilizer structure 146 may be integrally formed with the corresponding mounting structure 140L, 140R (e.g., by casting). Each stabilizer structure 146 defines an outer subslot or lug cavity 144C in its mounting slot 142.

Figure 6:
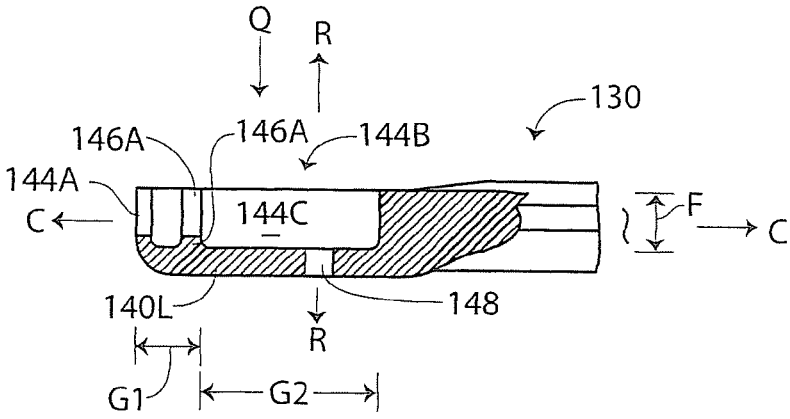
FIG. 6 is an enlarged, fragmentary, cross-sectional view of the mounting structure of FIG. 5 taken along the line 6-6 of FIG. 5.

According to some embodiments, each lug cavity 144C has a width E (FIG. 7) in the range of from about 2 to 3 inches. According to some embodiments, the clearance between each lug 116 and the adjacent side walls defining the lug cavity 144C is in the range of from about 0.005 to 0.03 inch. According to some embodiments, each lug cavity 144C has a depth F (FIG. 6) in the range of from about 0.5 to 1 inch. According to some embodiments, the depth F is greater than the thickness N (FIG. 2) of each lug 116. According to some embodiments, each mounting slot 142 has an inner length G1 (i.e., from the inner side of the axial entrance opening 144A to the lug cavity 144C; FIG. 6) in the range of from about 1 to 1.5 inches. According to some embodiments, each lug cavity 144C has a length G2 (i.e., from the outer side of the stabilizer structure 146 to the outer end of the lug cavity 144C; FIG. 6) in the range of from about 2 to 3 inches. According to some embodiments, the width H (FIG. 7) of each axial entrance opening 144A is in the range of from about 1 to 2 inches of the insulator 110 or 120 to be received thereby. According to some embodiments, the width I (FIG. 7) of each stabilizer slot 146A is in the range of from about 1 to 2 inches of the insulator 110 or 120 to be received thereby. According to some embodiments, the entrance opening 144A and the stabilizer slot 146A each provide a clearance in the range of from about 0.005 to 0.03 inch about the portion of the insulator 110, 120 received therein.

The end member 130 may be formed of any suitable material. According to some embodiments, the end member 130 is formed of an electrically conductive metal. According to some embodiments, the end member 130 is formed of aluminum. According to some embodiments, the end member 130 is unitarily cast.

The end member 150 may be constructed in the same manner as the end member 130. According to some embodiments and as shown, the retainer mechanism 136, 156 of the end members 130, 150 is configured such that the keeper bars 136A, 156A thereof open to the same side (as shown in FIG. 1). The end member 150 has mounting structures 160L, 160R corresponding to the mounting structures 140L, 140R and having respective mounting slots 162.

Figure 3:
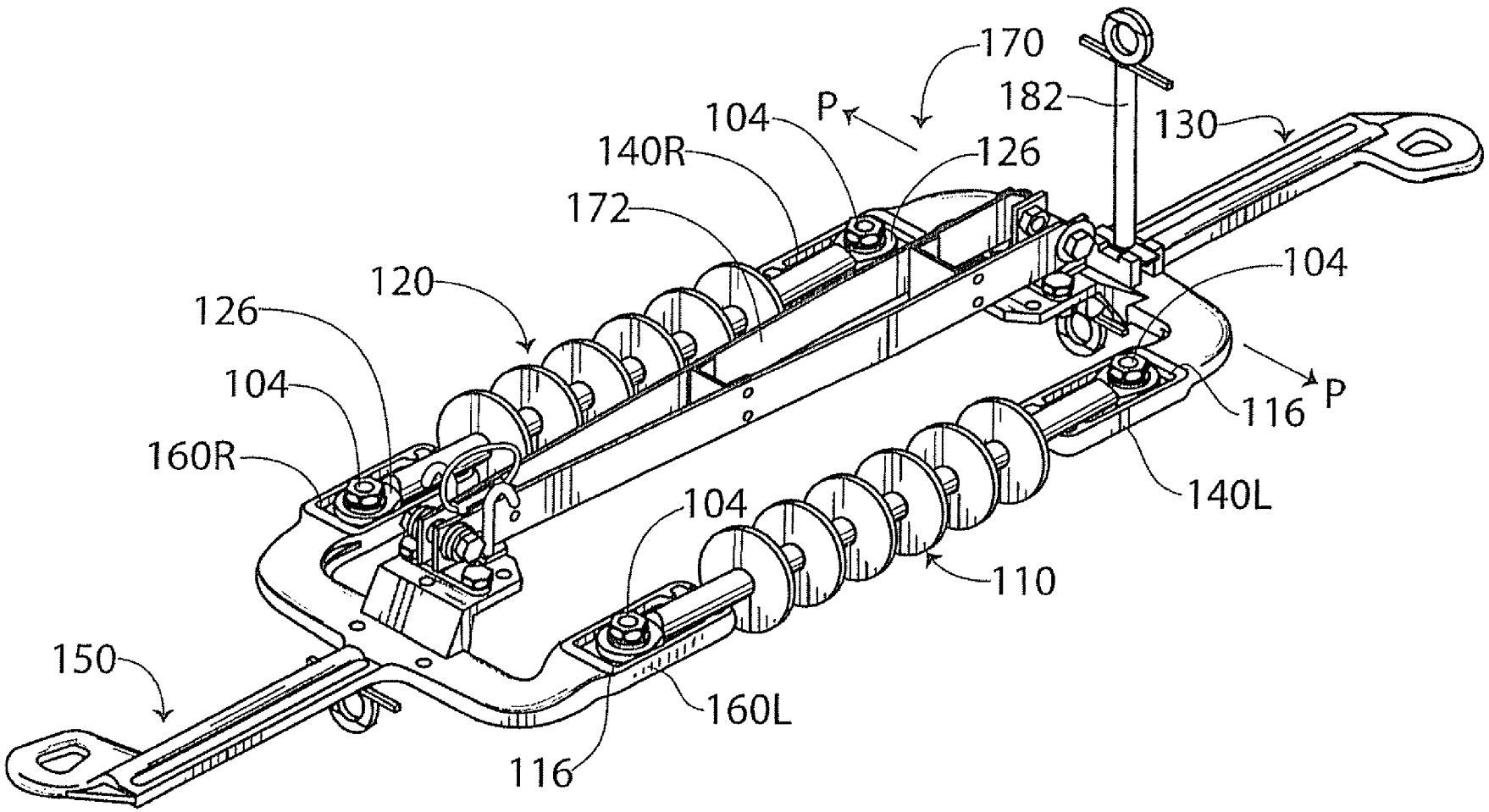
FIG. 3 is a bottom perspective view of the isolating apparatus of FIG. 1.
Figure 4:
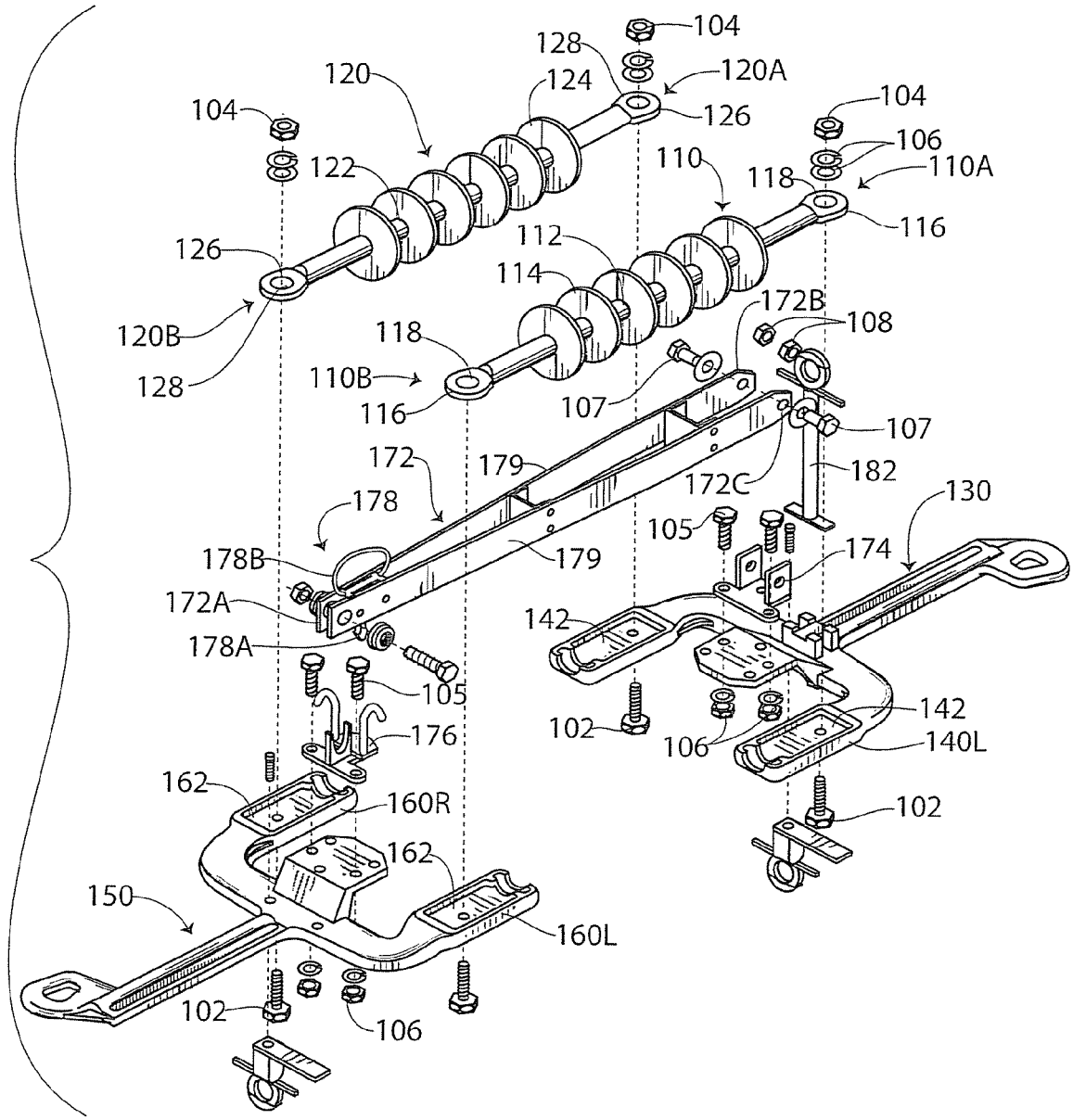
FIG. 4 is an exploded, bottom perspective view of the isolating apparatus of FIG. 1.
Figure 5:
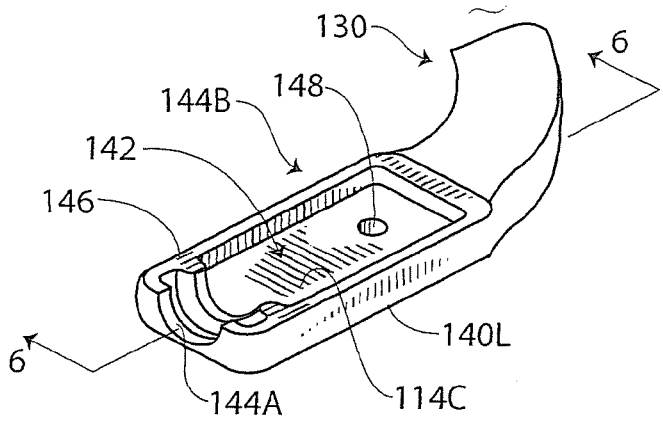
FIG. 5 is an enlarged, fragmentary, perspective view of a mounting structure of the isolating apparatus of FIG. 1.
Figure 9:
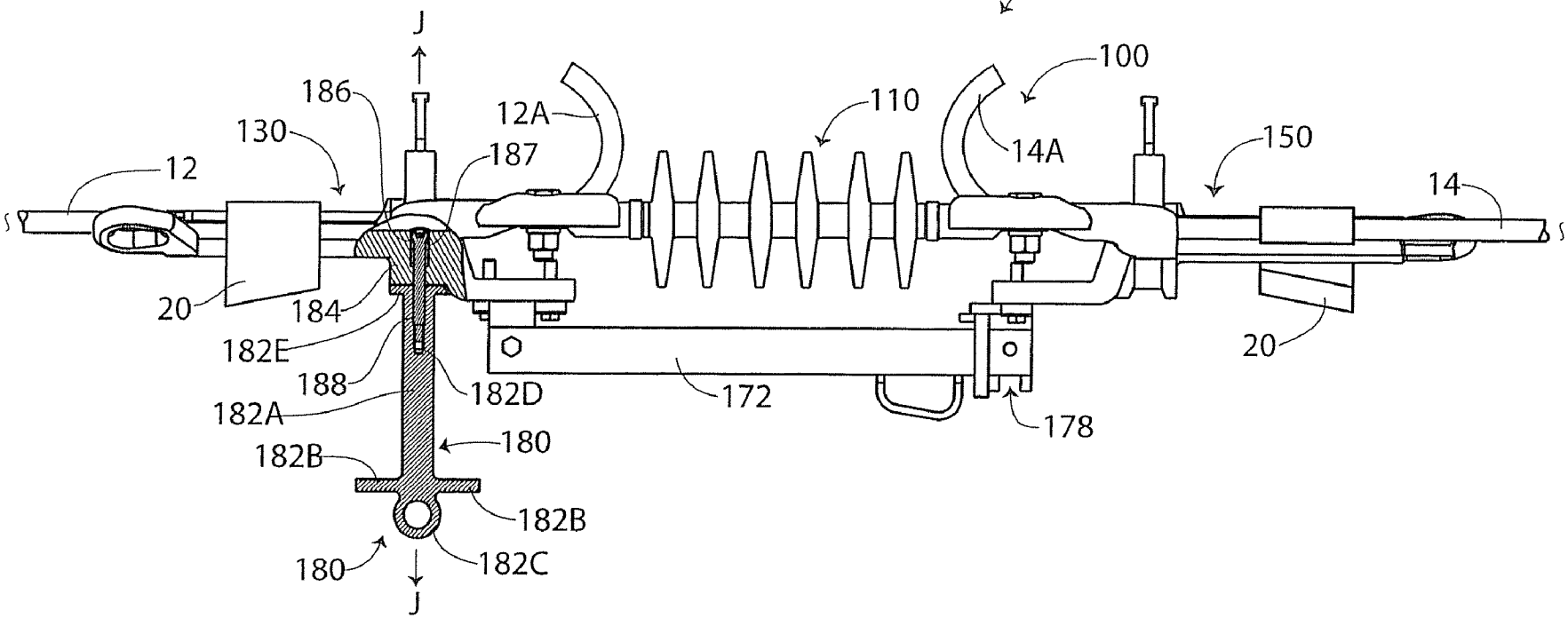
FIG. 9 is a fragmentary, side view of the isolating apparatus of FIG. 1 with the blade mechanism in the closed position.
Figure 11:
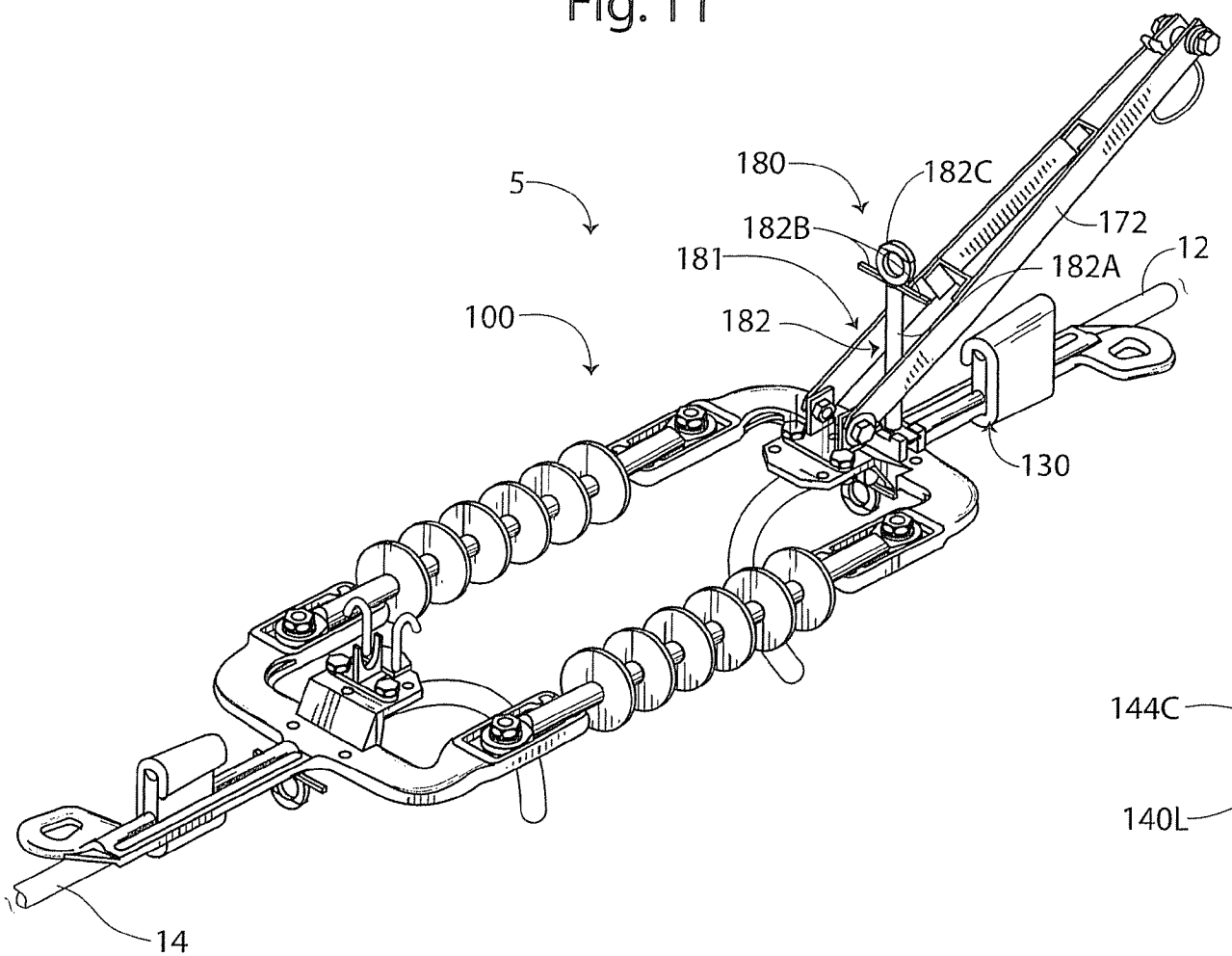
FIG. 11 is a top perspective view of the isolating apparatus of FIG. 1 mounted on the power line, wherein the blade switch mechanism is in a locked open position.

The blade switch mechanism 170 includes an electrically conductive blade member 172, a pivot bracket 174, a receiver bracket 176, and a latch mechanism 178. The receiver bracket 176 is mounted on the end member 150 and the pivot bracket is mounted on the end member 130. The blade member 172 includes a pair of blade plates 179 defining an opening 181 therebetween. The blade member 172 has a pivot end 172B pivotably coupled to the pivot bracket 174 (by a bolts 102 extending through pivot holes 172A) for rotation about a transverse pivot axis P-P (FIG. 3) between an open position as shown in FIG. 11 and a closed position as shown in FIGS. 3, 8 and 9. In the closed position, a contact end 172A of the blade member 172 is received in and contacts the receiver bracket 176 to provide electrical continuity between the end members 130 and 150 (more particularly, from the coupling rod 134 to the coupling rod 154). In the open position, the contact end 172A is spaced apart from the receiver bracket 176 and the end members 130, 150, being coupled only by the insulators 110, 120, are electrically isolated from one another.

A latch mechanism 178 may be provided to secure the blade member 172 in the closed position. The latch mechanism 178 includes a latch member 178A and a latch handle 178B for selectively disengaging and/or engaging the latch member 178A with the receiver bracket 176, for example.

The various components 172, 174, 176, 178A of the latch mechanism 170 can be formed of any suitable electrically conductive materials, such as copper, steel or aluminum.

The isolating apparatus 100 further includes a lockout mechanism 180. The lockout mechanism 180 includes a lockout member 182, a seat structure 184, a spring 186, and an anchor bolt 188. The lockout member 182 includes a shaft 182A, a pair of opposed lateral extensions or arms 182B extending laterally from the shaft 182A, a pull ring 182C, a threaded mount bore 182D, and a base 182E. The bolt 188 extends through a hole 187 in the end member 130 and is threadedly received in the bore 182D. The spring 186 is mounted on the shank of the bolt 188 and is seated in the hole 187. The base 182E of the lockout member 182 is seated in the seat structure 184 on the end member 130. The seat structure 184 includes risers or prongs 184A (FIG. 10) defining a longitudinal slot 184B and a transverse slot 184C. The base 182E can seat alternatively in the slot 184B or the slot 184C.

In use (as discussed in more detail below), the lockout member 182 can be pulled outwardly along a pull axis J-J against the force of the spring 186 and rotated about the axis J-J to reorient the extension arms 182B. Full removal of the lockout member 182 from the end member 130 is prevented by the head 188A of the bolt 188 and the spring 186.

The lockout member 182 may be formed of any suitable material, such as aluminum, for example.

Each wedge connector 20 includes a C-shaped clamp 22 and a wedge member 24. Suitable connectors 20 include AMPACT™ tap connectors available from Tyco Electronics Corporation. According to some embodiments, the wedge connectors 20 may be constructed and installed as disclosed in U.S. Pat. No. 5,942,723 to Laricchia and/or U.S. Published Patent No. 2007/0240301 (Johnston et al.), for example, the disclosures of which are incorporated herein by reference.

Figure 7:
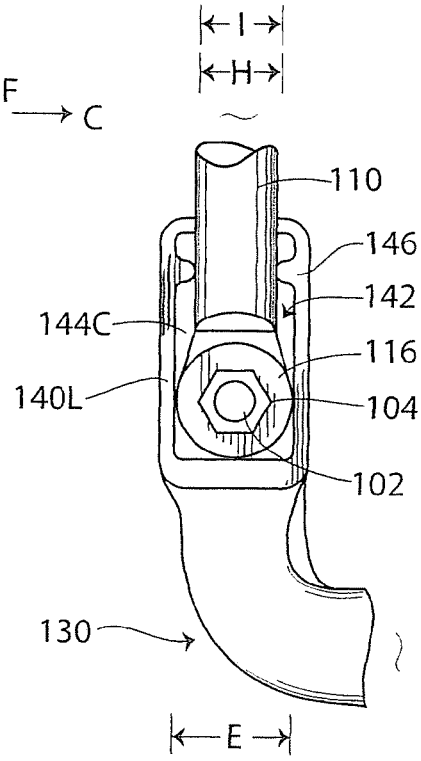
FIG. 7 is an enlarged, top plan view of the mounting structure of FIG. 5 with a round lug mounted therein.

The isolating apparatus 100 may be assembled in the following manner. The lug 116 on the insulator end 110A is mounted in the mounting slot 142 of the mounting structure 140L, the lug 116 on the insulator end 110B is mounted in the mounting slot 162 of the mounting structure 160L, the lug 126 on the insulator end 120A is mounted in the mounting slot 142 of the mounting structure 140R, and the lug 126 on the insulator end 120B is mounted in the mounting slot 162 of the mounting structure 160R. The lugs 116, 126 are each secured in their respective mounting slots 142, 162 by a respective set of bolt 102, nut 104 and washers 106. More particularly and referring to the coupling of the lug 116 on the insulator end 110A to the mounting structure 140L, which is exemplary of the couplings of the other lugs 116, the lug 116 is laterally inserted or laid into the mounting slot 142 through the lateral opening 144B as indicated by the directional arrow Q in FIG. 6. As shown in FIG. 7, the lug 116 is seated in the mounting slot 142 such that lug 116 is positioned in the lug cavity 144C and the remainder of the insulator 110 (e.g., the body 112) extends axially out of the mounting slot 132 through the stabilizer structure slot 146A and the axial entrance opening 144A. The bolt 102 is inserted through the hole 148 and the lug hole 118 and secured by the nut 104. The bolt 102 and nut 104 thus prevent the lug 116 from being displaced laterally or axially from the mounting slot 142. The stabilizer structure 146 and the entrance opening 144A inhibit or prevent rotation of the lug 116 about the bolt 102.

The brackets 174 and 176 are secured to the end members 130 and 150, respectively, by corresponding bolts 105 and nuts 106. The blade member 172 is pivotably connected to the bracket 174 by bolts 107 and nuts 108. The retainer mechanisms 136 can be secured to the respective end members 130, 150 as disclosed in U.S. Pat. No. 5,942,723 to Laricchia, for example. The lockout member 182 is secured to the end member 130 by the bolt 188 and the spring 186.

Once assembled, the insulators 110, 120 extend between the end members 130, 150 in spaced apart, coextensive, substantially parallel relation. The mounting slots 142, 162 open laterally with respect to the lengthwise axes A-A, B-B of the respective installed insulators 110, 120.

Once the isolating apparatus 100 has been assembled, it may be installed on a power line 10 in a known manner, for example. According to some methods, the keeper bars 136A are placed in their open positions. The isolating apparatus 100 is laid on the power line 10 with the grooves 134A facing downwardly and such that the power line 10 extends through the grooves 134A and between the end members 130, 150. The keeper bars 136A are then moved (e.g., using hotsticks) to their closed positions so that they capture the power line 10 in the grooves 134A. The isolating apparatus 100 is then rotated 180 degrees about the power line 10 to the upright position as shown in FIG. 8.

The wedge clamps 20 are then installed about the power line 10 and each coupling rod 134 as shown in FIG. 8. The wedge clamps 20 may be installed using a powder-actuated impact tool, for example.

The power line 10 can then be cut between the end members 130, 150 to divide the power line 10 into two separate cable segments or cables 12, 14. The cables 12 and 14 are securely coupled to the end member 130 and the end member 150, respectively, so that the tension from the power line 10 is now applied to the isolating apparatus 100. The cut ends 12A, 14A can then be bent away from one another as shown in FIG. 8 to electrically isolate the cables 12, 14 from one another and/or a section of the power line 10 between the end members 130, 150 can be cut out and removed.

When it is desired to electrically connect the cables 12, 14, the blade member 172 can be pivoted into the closed position as shown in FIGS. 8 and 9 to electrically connect the end members 130, 150. The blade member 172 can be securely and releasably retained in the closed position by the latch mechanism 178.

Figure 10:
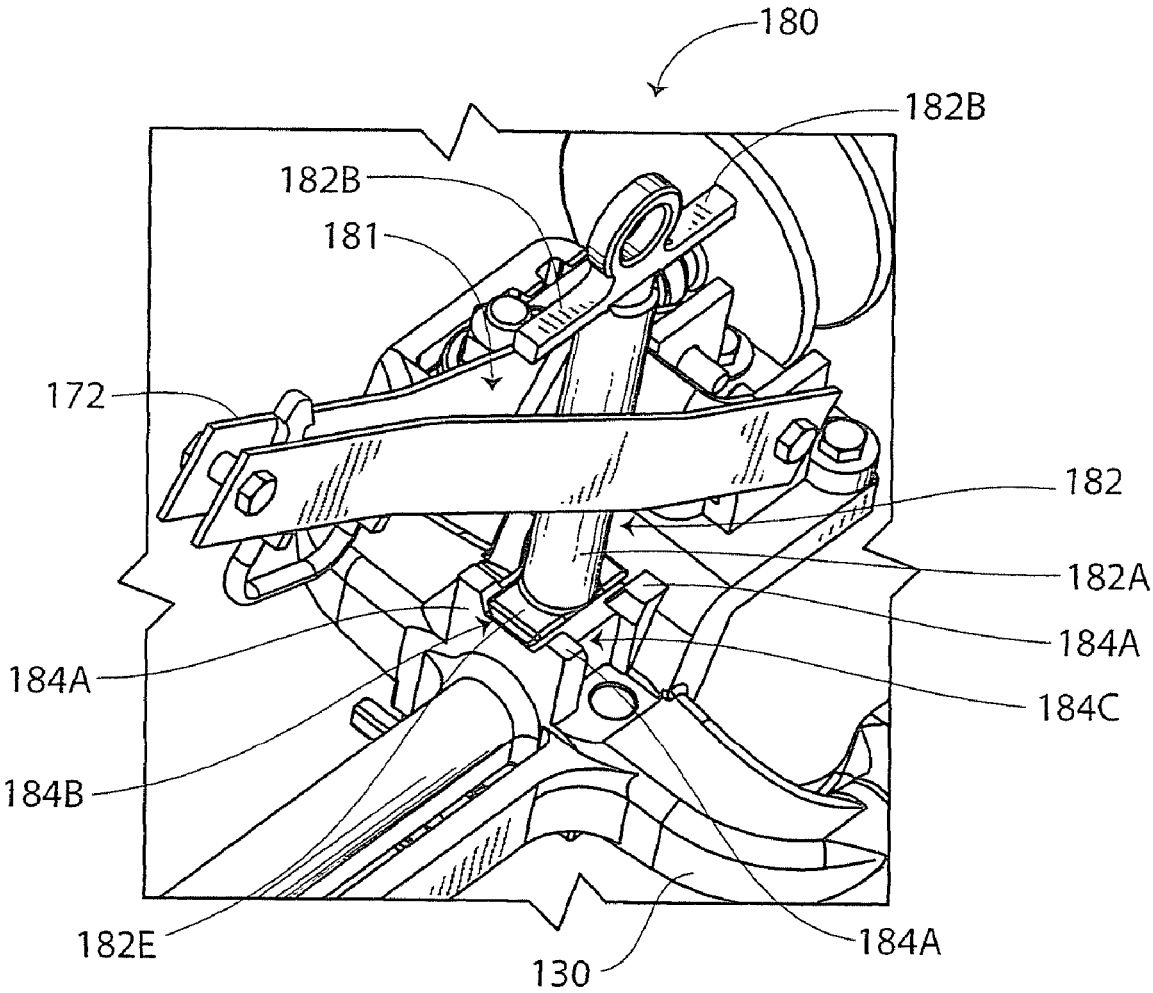
FIG. 10 is an enlarged, fragmentary, perspective view of the isolating apparatus of FIG. 1 wherein a blade thereof is in an open position and a lockout mechanism thereof is in an unlocked position.

When it is desired to electrically isolate or disconnect the cables 12, 14, the blade member 172 can be pivoted into its open position as shown in FIGS. 10 and 11. The lockout mechanism 180 can be used to securely and releasably retain the blade member 172 in its open position. More particularly, the lockout member 182 is rotated to a position wherein the extension arms 182B will pass through the opening 181 in the blade member 172 (which may be referred to as an "unlocked position" of the lockout member 182) as shown in FIG. 10. The lockout member 182 can be secured in the unlocked position by seating the base 182E in the longitudinal slot 184B. The spring 186 retains the base 182E in the slot 184B. When the blade member 172 is swung into the open position, the lockout member 182 is received through or proximate the opening 181. The lockout member 182 is then pulled outwardly along the axis J-J against the bias of the spring 186 until the shaft 182A extends through the opening 181 and the extension arms 182B clear the blade member 172. The lockout member 182 is then rotated about 90 degrees and released so that the extension anus 182B overlap or intersect the swing path of the blade plates 179 and the lockout member 182 captures the blade member 172 (which may be referred to as a "locked position" of the lockout member 182) as shown in FIG. 11. The lockout member can be secured in the locked position by seating the base 182E in the transverse slot 184C. The spring 186 retains the base 182E in the slot 184C.

According to some embodiments, in the locked position the spring 186 continues to apply a tension load on the lockout member 182 to bias the extension arms 182A against the fully open blade member 172. In this configuration, it is necessary to pull the lockout member 182 outwardly against the force of the spring 186 to enable the extension arms 182B to be rotated and free the blade member 172. The blade member 172 is thereby prevented from returning to the closed position unless and until an operator deliberately returns the lockout member 182 to the unlocked position, whereupon the blade member 172 can be pivoted to the closed position. More particularly, the operator can pull the lockout member 182 outwardly and rotate it about 90 degrees until the extension arms 182A are substantially clear of the blade plates 179.

Figure 12:
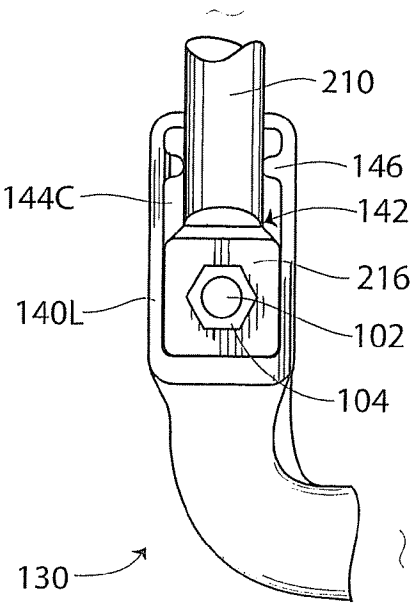
FIG. 12 is an enlarged, top plan view of the mounting structure of FIG. 5 with a square lug mounted therein.

While the insulators 110, 120 as described above have round profile lugs 116, the end members 130, 150 are further adapted to form an isolating apparatus 100 with insulators having rectangular (e.g., square) lugs. With reference to FIG. 12, an insulator 210 having a square profile lug 216 is shown therein. The square lug 216 can be installed and secured by a bolt 102 and nut 104 in the mounting slot 142 of the mounting portion 140L in the same manner as described above with regard to the round lug 116. The mounting slots 142, 162 of the other mounting portions 140R, 160L, 160R are likewise adapted and configured to effectively receive and couple with square lugs 216. Thus, the isolating apparatus 100 can be formed using the same two end members 130, 150 and insulators having round lugs, square lugs, or any combination thereof.

The isolating apparatus 100 can provide a number of advantages over known power line isolating devices. The isolating apparatus 100 incorporates the end members 130, 150, the insulators 110, 120, and the blade member 172 as modular components with flexible and noncomplex coupling mechanisms. The isolating apparatus 100 can be assembled quickly and efficiently without requiring specialized tools or skills. The isolating apparatus 100 can be assembled by an installer in the field. The isolating apparatus 100 can be quickly maintained and repaired, such as by replacing one or more damaged components (e.g., an insulator 110, 120 and/or the blade member 172). The isolating apparatus 100 can employ readily available and standard hardware (e.g., the bolts 102, nuts 104 and washers 106) and insulators 110, 120 rather than requiring the manufacture and inventorying of certain specialized components.

The use of a bolt 102 (and, according to some embodiments, a single bolt 102) to secure each lug 116, 126 to couple the insulators 110, 120 provides an effective mechanism for securing the insulators 110, 120 to the end members 130, 150 that can be quickly and simply executed. The single bolt installation also permits the use of industry standard lugged insulators, thereby eliminating the need for expensive crimping of insulator fittings to the yokes 132, 152.

The stabilizer structures 146, 166 in each mounting slot 142, 162 extend along either side of the received insulator 110, 120 to securely hold the ends of the insulators 110, 120 in the mounting slots 142, 162. The stabilizer structures 146 thereby limit or prevent rotation of each lug 116, 126 about the axis of the bolt 102 by which the lug 116, 126 is secured (i.e., the axis R-R transverse to the lengthwise axis A-A, B-B of the insulator 110, 120 (FIG. 6)) to maintain the rigidity of the isolating apparatus 100.

Each mounting slot 142, 162 is configured to serve as a universal adaptor to accept various standard insulator lug configurations. In particular, the mounting slots 142, 162 are each configured to receive either of the industry standard round lugs 116 and the industry standard rectangular lugs 216. Mounting slots according to embodiments of the present invention may be configured to operatively accept other shapes, as well.

The modular design of the isolating apparatus 100 also permits the isolating apparatus 100 to be selectively configured or customized as desired for the intended application. According to some methods of the present invention, a plurality of insulators 110, 120 and/or blade members 172 of different lengths or other attributes are provided and an assembler selects from the plurality of insulators and/or blade members those appropriate to provide the intended attributes of the isolating apparatus 100. For example, a plurality of insulators 110, 120 of different lengths and blade members 172 of corresponding lengths may be provided each corresponding to a different voltage rating (e.g., longer insulators providing a higher voltage rating). In assembling the isolating apparatus 100, the assembler selects the insulators 110, 120 and blade member 172 from the plurality of insulators having the length corresponding to the desired voltage rating. According to some embodiments, the assembler is a field installer. According to some embodiments, the end members 130, 150 are supplied as a system or kit with a plurality of insulators of different lengths and, in some embodiments, also with a plurality of blade members of different lengths matched to the lengths of the insulators. According to some embodiments, the end members 130, 150 are provided as a system or kit with a plurality of blade members of different lengths matched to industry standard lengths of insulators (though the insulators themselves may not be provided as part of the kit). Systems as described may reduce the inventory of components needed by the installer and/or may permit the installer to use industry standard insulators on hand. According to some embodiments, the plurality of insulators provided can be configured to provide an isolating apparatus 100 having a voltage rating across the range of 15 to 69 kV.

The lockout mechanism 180 can provide positive locking of the blade member 172 in its fully open position to prevent accidental blade rotational movement that would close the isolating apparatus 100 and thereby the electrical loop of the power line 10. In this manner, the lockout mechanism 180 can provide improved operational safety without unduly increasing the cost or operational requirements of the isolating apparatus 100.

According to further embodiments of the present invention, the isolating apparatus 100 can be provided without the blade mechanism 170, without the lockout mechanism 180, or without the blade mechanism 170 and the lockout mechanism 180.

According to some embodiments, the lockout mechanism 180 may be provided on isolating apparatus of other designs or configurations (e.g. not having mounting slots and/or lugged insulators as disclosed herein).

While the insulating apparatus 100 has been described herein installed on segments 12, 14 of a power line 10, according to some embodiments, the insulating apparatus 100 may be installed on each of a cable and a dead end post, for example.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed is:

1. An end member for forming an isolating apparatus for an electric power line, the isolating apparatus including a pair of the end members and an elongate insulator, the end member comprising:

an electrically conductive end member body having a mounting slot defined therein;

wherein the mounting slot is arranged and configured to receive an insulator end of the insulator;

wherein the end member includes at least one stabilizer structure extending into the mounting slot and configured to engage the insulator end to limit rotation of the insulator about an axis transverse to a lengthwise axis of the insulator.

2. The end member of claim 1 including a fastener to secure the insulator end to the end member.

3. The end member of claim 2 wherein:

the end member body has a second mounting slot defined therein; and the second mounting slot is arranged and configured to receive an insulator end of a second insulator to secure the insulator end of the second insulator to the end member such that the first and second insulators extend from the end member in spaced apart, coextensive, substantially parallel relation.

4. The end member of claim 2 wherein the fastener is a bolt to secure the insulator end in the mounting slot by only the single bolt.

5. The end member of claim 1 wherein the mounting slot is configured to alternatively receive each of a square insulator lug and a round insulator lug of the insulator.

6. The end member of claim 1 wherein the insulator defines a lengthwise axis extending between the insulator ends, and the mounting slot opens laterally with respect to the lengthwise axis to receive the respective one of the insulator ends.

7. The end member of claim 1 wherein the body includes a coupling rod to secure the end member to the power line.

8. The end member of claim 1 further including a blade switch including an electrically conductive blade member electrically and pivotally connected to the end member body such that the blade member is selectively movable between a closed position and an open position.

9. An isolating apparatus for an electric power line, the isolating device comprising:

an elongate insulator having opposed insulator ends;

first and second electrically conductive end members each secured to a respective one of the insulator ends;

a blade switch including an electrically conductive blade member electrically and pivotally connected to the first end member, wherein the blade member is selectively movable between a closed position, wherein the blade member engages the second end member to provide electrical continuity between the first and second end members, and an open position, wherein the blade member is out of contact with the second end member; and a lockout mechanism selectively operable to secure the blade member in the open position and, alternatively, to permit the blade member to be transitioned to the closed position;

wherein the locking mechanism includes a locking member that is rotatable between a locked position and an unlocked position.

10. The isolating apparatus of claim 9 wherein the locking member extends through the blade member when the blade member is in the open position.

11. The isolating apparatus of claim 9 including a spring member to retain the locking member in the locked position.

12. The end member of claim 8 further including a lockout mechanism selectively operable to secure the blade member in the open position and, alternatively, to permit the blade member to be transitioned to the closed position.

13. An end member for forming an isolating apparatus for an electric power line, the isolating apparatus including a pair of the end members and an elongate insulator, the end member comprising:

an electrically conductive end member body having a mounting slot defined therein;

wherein the mounting slot is arranged and configured to receive an insulator end of the insulator;

wherein the insulator defines a lengthwise axis extending between the insulator ends, and the mounting slot opens laterally with respect to the lengthwise axis to receive the respective one of the insulator ends.

14. The end member of claim 13 including a fastener to secure the insulator end to the end member.

15. The end member of claim 14 wherein the fastener is a bolt to secure the insulator end in the mounting slot by only the single bolt.

16. The end member of claim 13 wherein:

the end member body has a second mounting slot defined therein; and the second mounting slot is arranged and configured to receive an insulator end of a second insulator to secure the insulator end of the second insulator to the end member such that the first and second insulators extend from the end member in spaced apart, coextensive, substantially parallel relation.

17. The end member of claim 13 wherein the mounting slot is configured to alternatively receive each of a square insulator lug and a round insulator lug of the insulator.

18. The end member of claim 13 wherein the body includes a coupling rod to secure the end member to the power line.

19. The end member of claim 13 further including a blade switch including an electrically conductive blade member electrically and pivotally connected to the end member body such that the blade member is selectively movable between a closed position and an open position.

20. The end member of claim 19 further including a lockout mechanism selectively operable to secure the blade member in the open position and, alternatively, to permit the blade member to be transitioned to the closed position.

* * * * *